United States Patent [19]

Wunderlich

[11] Patent Number: 4,461,349

[45] Date of Patent: Jul. 24, 1984

[54] LONG-LINE-DRIVE PATTERN FOR IN SITU GASIFICATION OF SUBTERRANEAN CARBONACEOUS DEPOSITS

[75] Inventor: Donald K. Wunderlich, Richardson, Tex.

[73] Assignee: Atlantic Richfield Company, Los Angeles, Calif.

[21] Appl. No.: 446,901

[22] Filed: Dec. 6, 1982

[51] Int. Cl.[3] ..... E21B 43/243; E21B 43/30

[52] U.S. Cl. ..... 166/245; 166/251

[58] Field of Search ..... 166/245, 256, 259, 261, 166/251, 64

[56] References Cited

U.S. PATENT DOCUMENTS

| | | | |
|---|---|---|---|
| 3,205,942 | 9/1965 | Sandberg | 166/245 |
| 3,386,504 | 6/1968 | Kunetka | 166/256 X |
| 3,997,005 | 12/1976 | Komar | 166/256 X |
| 3,999,607 | 12/1976 | Pennington et al. | 166/261 X |
| 4,222,437 | 9/1980 | Sabol | 166/245 |
| 4,306,621 | 12/1981 | Boyd et al. | 166/259 X |

*Primary Examiner*—Stephen J. Novosad

*Attorney, Agent, or Firm*—Robert M. Betz

[57] ABSTRACT

A row of injection wells is widely separated from a parallel row of production wells by a plurality of rows of intermediate uncased column wells by means of which combustion links are established between the respective injection and production wells perpendicular to such rows. The pattern is ignited through a row of intermediate wells in order to prevent combustion from occurring directly beneath the injection wells. Means are also provided for shutting down the operation before the burn front reaches the production wells. In this manner, the danger of subsidence at both injection and production wells during operations is substantially eliminated.

4 Claims, 1 Drawing Figure

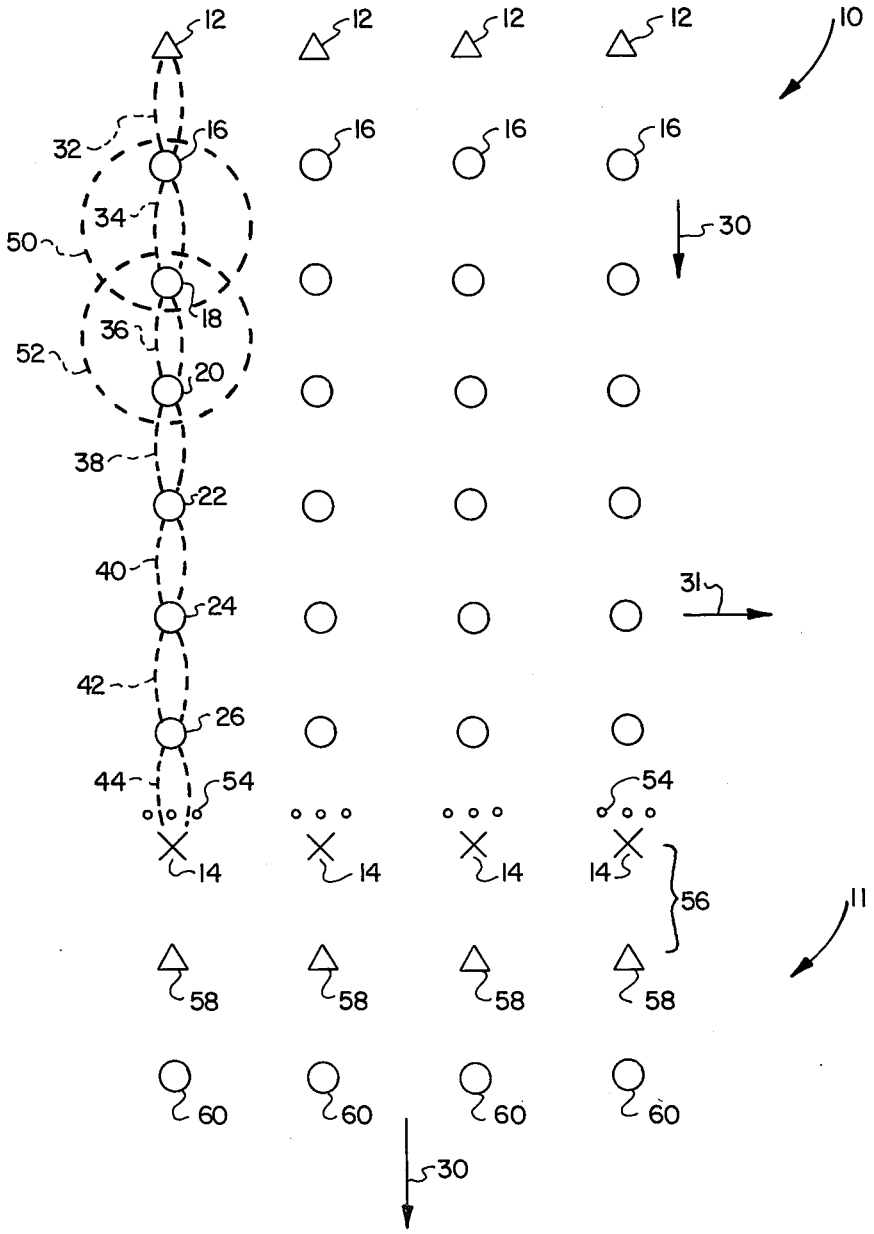
12
12
12
12
10
32
16
16
16
16
34
30
50
18
36
52
20
38
22
40
31
24
42
26
44
54
54
14
14
14
14
56
11
58
58
58
58
60
60
60
60
30

LONG-LINE-DRIVE PATTERN FOR IN SITU GASIFICATION OF SUBTERRANEAN CARBONACEOUS DEPOSITS

BACKGROUND OF THE INVENTION

This invention relates to methods for gasifying subterranean deposits. More particularly this invention to an improved line-drive method for gasifying such deposits.

Considerable effort has been directed heretofore in the development of processes for conversion of carbonaceous materials such as coal into liquid or gaseous fuels which may be substituted for petroleum-derived fuels. Of particular interest in this connection is the in situ gasification of coal deposits. One well-known method for gasifying such subterranean deposits over a wide area is the so-called line-drive process. In this process well bores are drilled at suitable spacings in substantially parallel rows positioned generally perpendicularly to the direction of the line drive, i.e. the direction in which the burn front is to proceed. In this process, the free oxygen containing gas is injected into a first row of well bores designated injection well bores with ignition and gasification of the coal being accomplished between such first row and an adjacent row of production well bores. When gasification is complete between the first and second rows, the process is continued by converting the production wells to injection wells and utilizing a succeeding row of wells as production wells. In such prior art processes several drawbacks are inherent. In the first place the use of well bores for both injection and production operations results in less efficient gasification of the subterranean deposit than would be accomplished if the wells were used for a single purpose, i.e., injection or production. The cost of completion of dual-purpose wells is particularly high. When linking is attempted from a well which has previously been used for production, the bottom of the well may be burned off, which makes it impossible to control the positioning of the combustion link in the deposit so that combustion can be initiated near the bottom of the subterranean deposit. As is well known, combustion is desirably initiated near the bottom of a carbonaceous deposit for most-effective gasification.

A further operational problem with the prior art line-drive process stems from the fact that combustion takes place in the immediate vicinity and beneath both the injection and production wells. Subsidence is likely to occur at both wells. This may damage the injection wells sufficiently to interfere with the flow of oxygen containing gas and thus interrupt the gasification process; damage to production wells may cause leakage of gasification products from the production wells with consequent environmental hazard.

A still further drawback of conventional short-line-drive configurations is the fact that the active areas of each line-drive pattern are in direct contact with the preceding burned-out pattern. This enhances the likelihood of escape of gasification products to the surface through such burned-out patterns.

A still further problem with the conventional short-line-drive pattern is that it is relatively susceptible to a high rate of water influx because of the considerable length of exposed perimeter in relation to the internal deposit area undergoing conversion.

It is therefore a general object of this invention to provide an improved line-drive pattern for in situ gasification of subterranean carbonaceous deposits.

It is a further and more particular object of this invention to provide a line-drive pattern for in situ gasification of subterranean carbonaceous deposits wherein subsidence is substantially eliminated as an operational problem.

A still further object of this invention is to provide a line-drive pattern for in situ gasification of subterranean carbonaceous deposits wherein large areas may be efficiently produced without environment hazard.

Other objects and advantages of this invention will become apparent from consideration of the detailed description to follow taken in conjunction with the drawing and the appended claims.

SUMMARY OF THE INVENTION

In accordance with the prefered embodiment of this invention a long-line-drive pattern for in situ coal gasification is established by positioning parallel rows of injection and production wells extending generally perpendicularly to a desired direction of line drive, said injection and production wells being spaced apart at any arbitrary length, say two to four hundred feet. Plural inexpensive column wells are drilled in rows between the injection and production wells at reasonable spacing for combustion linking in the line-drive direction. Linking is then accomplished between each injection well and its associated producer well in the line-drive direction through through a chain of intermediate column wells. The pattern is then ignited at the first row of column wells adjacent to the injection wells. With a sufficient rate of flow of oxygen containing gas through the injection wells, the deposit will not burn back toward such injection wells; rather the gasification process will move only forward in the direction of the line drive toward the production wells thereby preventing combustion from occurring beneath the injection wells. Thermocouple wells may be positioned adjacent to the production wells such wells being provided with sensors adapted to signal the proximity of the advancing burn front and thus shut down the operation before combustion reaches the deposit immediately beneath the production wells.

A BRIEF DESCRIPTION OF THE DRAWINGS

The drawing illustrates a long-line-drive pattern for gasification of subterranean carbonaceous deposits in accordance with the preferred embodiment of this invention.

DESCRIPTION OF THE PREFERRED EMBODIMENTS

Referring now to the drawing there is shown a long-line-drive pattern 10 is accordance with this invention. A row of spaced-apart injection wells 12 of arbitrary length situated at one end of pattern 10 is separated from a parallel row of production wells 14 at the opposite end of pattern 10 by a plurality of parallel rows of intermediate column wells 16, 18, 20, 22, 24 and 26. The length of pattern 10 in long-line-drive direction 30 is set arbitrarily, two hundred to four hundred feet being reasonable. The spacing between intermediate column wells may be as great as permissible to support conventional linking, a distance of 50 feet between rows being typical. The pattern 10 may also extend as far as desired in direction 31.

Linking is typically established between injection wells 12 and production wells 14 by the use of reverse-combustion linking, by horizontal drilling or the like. For example, in the practice of reverse-combustion linking free oxygen containing gas is injected into injection wells 12 until significant oxygen flow is detected at the first row of intermediate wells 16. At such time as sufficient oxygen flow is detected in intermediate wells 16 ignition is then accomplished through wells 16 by a variety of techniques known to those in the art such as the use of pyrophoric materials and the like, combustion then continues until a permeable combustion link 32 is established back to injection wells 12. This process of reverse combustion linking is then repeated by ignition in succession through the remaining rows of intermediate wells 18, 20, 22, 24 and 26 and finally ignition is accomplished through production wells 14. In this manner successive intermediate combustion links 34, 36, 38, 40, 42 and 44 are established so as to complete the desired overall combustion link between each injection well 12 and associated production well 14.

After combustion links 32 through 44 are established the supporting gas flow may be interrupted so as to extinguish any existing burn fronts or combustion in the pattern 10. Ignition of pattern 10 is now provided through the first row of intermediate wells 16 in conjunction with a restarted flow of gas through injection wells 12. Gasification now proceeds in area 50 between wells 16 and 18. It is a feature of this invention that gasification of the deposit does not simultaneously occur in a reverse direction between intermediate wells 16 and injection wells 12. As oxygen containing gas flows from injection wells 12 in the line-drive direction 30 through combustion link 32 it conducts heat away from the unburned deposit face in area 50 intersecting link 32. When the rate of flow of oxygen containing gas from injection wells 12 is increased sufficiently, this cooling effect prevents the burn front from propagating further toward injection wells 12.

As gasification of the deposit proceeds in the manner described through areas 52 and succeeding intermediate areas of the deposit, gasification-product gas is recovered from production wells 14. In order to prevent combustion from reaching the vicinity of or beneath production wells 14, the advancing burn front may be detected by means of thermocouples positioned in thermocouple wells 54, intermediate wells 26 and production wells 14. By conventional means not shown, these thermocouples may signal signal the arriving burn front and trigger a suitable alarm means so as to enable the shutdown of the operation before the burn front reaches production wells 14.

In the manner described, both injection wells 12 and production wells 14 are isolated from the immediate combustion zone of the deposit undergoing gasification with consequent avoidance of subsidence problems. Subsidence beneath the intermediate wells 16 through 26 is not of great concern because after linking is accomplished such wells are usually plugged. Damage to the bottom of such wells thereafter does not interfere with operations.

Because of the area encompassed by pattern 10 in relation to the length of its exposed perimeter it is less susceptible to water influx problems than a typical prior-art short-line-drive pattern. Furthermore because of the large area of gasification of pattern 10 it is now economic to leave an unburned barrier space 56 between pattern 10 and a succeeding long-line-drive pattern 11 (partially shown) beginning with a row of injection well bores 58 and an adjacent intermediate row of well bores 60. In this way there is no direct connection between active and burned-out patterns as in the conventional short-line-drive situation, nor is there any need for reuse of wells.

A further advantage of this invention lies in the fact that the plural intemediate wells as described can be much-less-expensively completed than either the injection or production wells of the prior art which serve a dual function as described above.

It should be understood that subterranean carbonaceous deposits generally considered suitable for the practice of the present invention include various grades of coal, oil shales, tar sands, heavy deposits and the like. The invention is, however, particularly suited to the recovery of gasification products from subterranean coal deposits.

What has been described is illustrative only and many variations thereof and modifications in the processing steps described may be made within the scope of this invention as more particularly expressed in the appended claims.

What is claimed is:

1. An improved line-drive process for gasifying a subterranean carbonaceous deposit comprising the steps of:

(a) positioning injection well bores and proproduction well bores in spaced-apart rows substantially perpendicular to a line-drive direction, (b) positioning a plurality of rows of intermediate linking wells between said row of injection wells and said row of production wells, (c) establishing a combustion link between each injection well and respective one of said production wells in the line-drive direction by means of said intermediate linking wells lying therebetween, (d) injecting a free oxygen containing gas into the deposit underlying said pattern through said injection wells, (e) igniting said pattern through the row of said linking wells adjacent to said injection wells, and (f) recovering gasification product gas through production well bores.

2. A method as in claim 1 including the further step of positioning thermocouple wells in the vicinity of said production wells for detecting the advance of the combustion burn front in the line-drive direction.

3. The method of claim 1 wherein said carbonaceous deposit is coal.

4. The method of claim 1 wherein said carbonaceous deposit is a heavy oil deposit.

* * * * *